US008882899B2

(12) United States Patent
Aretz et al.

(10) Patent No.: US 8,882,899 B2
(45) Date of Patent: Nov. 11, 2014

(54) METHOD AND PLANT FOR PRODUCING ASPHALT MIXTURE

(75) Inventors: Julia Aretz, Essen (DE); Christian Barczus, Witten (DE); Wladimir Garber, Duesseldorf (DE); Stefan Wolber, Krefeld (DE)

(73) Assignee: LOESCHE GmbH, Duesseldorf (DE)

( * ) Notice: Subject to any disclaimer, the term of this patent is extended or adjusted under 35 U.S.C. 154(b) by 208 days.

(21) Appl. No.: 13/503,612

(22) PCT Filed: Dec. 28, 2009

(86) PCT No.: PCT/EP2009/009292

§ 371 (c)(1),
(2), (4) Date: Apr. 23, 2012

(87) PCT Pub. No.: WO2011/047705

PCT Pub. Date: Apr. 28, 2011

(65) Prior Publication Data

US 2012/0204761 A1 Aug. 16, 2012

(30) Foreign Application Priority Data

Oct. 23, 2009 (DE) ..... 10 2009 050 506

(51) Int. Cl.
*C08L 95/00* (2006.01)
*E01C 19/10* (2006.01)

(52) U.S. Cl.
CPC ..... *E01C 19/1004* (2013.01); *E01C 2019/1095* (2013.01); *E01C 19/1036* (2013.01); *E01C 2019/109* (2013.01)
USPC ..... 106/276; 106/281.1; 106/407; 366/4; 366/25; 432/113

(58) Field of Classification Search
USPC ..... 106/276, 281.1, 407; 366/4, 25; 432/113
See application file for complete search history.

(56) References Cited

U.S. PATENT DOCUMENTS 3,971,666 A 7/1976 Mendenhall
RE29,496 E * 12/1977 Dydzyk ..... 366/25

(Continued)

FOREIGN PATENT DOCUMENTS

CN 2087209 U 10/1991
CN 1369333 A 9/2002

(Continued)

OTHER PUBLICATIONS

International Preliminary Report on Patentability for International Application No. PCT/EP2009/009292, Apr. 2012.

(Continued)

*Primary Examiner* — Helene Klemanski
(74) *Attorney, Agent, or Firm* — Studebaker & Brackett PC

(57) ABSTRACT

The invention relates to a method and a plant for producing asphalt mixture and is directed in particular to the recycling of recovered asphalt. In order to achieve recycling of up to 100% recovered asphalt and to produce an asphalt mixture with the required quality, it is provided according to the invention that at least the drying and heating of the asphalt granulate and/or aggregates are carried out in a low oxygen atmosphere. The low oxygen atmosphere is achieved by supplying low oxygen gases with an oxygen content of maximum 10%, preferably with an oxygen content of maximum 5%. The conveyance of the heated and dried asphalt granulate and/or aggregates, the siloing and mixing with bitumen to form a new, incorporation-ready asphalt mixture also usefully take place in a low oxygen atmosphere.

28 Claims, 6 Drawing Sheets

(56) References Cited

U.S. PATENT DOCUMENTS

Figure 1:
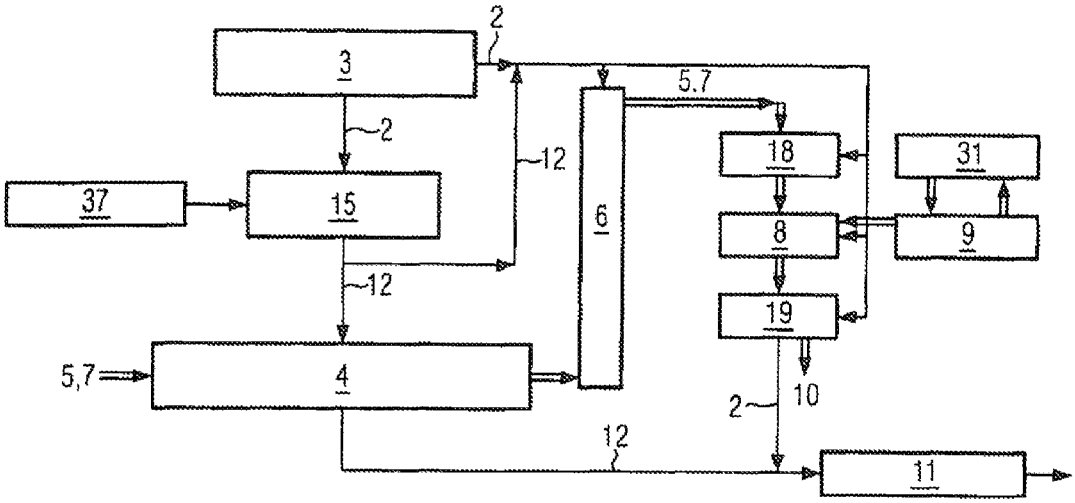

| | | | | | |
|---|---|---|---|---|---|
| 4,190,370 | A | | 2/1980 | Brock et al. | |
| 4,249,890 | A | * | 2/1981 | Graham | 432/13 |
| 4,387,996 | A | * | 6/1983 | Mendenhall | 366/4 |
| 4,477,250 | A | * | 10/1984 | Brashears et al. | 432/3 |
| 4,932,785 | A | | 6/1990 | Bracegirdle | |
| 5,810,471 | A | | 9/1998 | Nath et al. | |
| 8,220,982 | B2 | * | 7/2012 | Musil | 366/25 |

FOREIGN PATENT DOCUMENTS

| | | | |
|---|---|---|---|
| CN | 2532108 | Y | 1/2003 |
| CN | 2608544 | Y | 3/2004 |
| EP | 0119328 | A2 | 9/1984 |
| EP | 2071080 | A2 | 6/2009 |
| GB | 1526360 | A | 9/1978 |
| RU | 2139969 | C1 | 10/1999 |
| RU | 46767 | U1 | 7/2005 |
| SU | 424941 | A1 | 4/1974 |
| SU | 962406 | A1 | 9/1982 |
| SU | 1270198 | A2 | 11/1986 |
| UA | 15810 | U | 7/2006 |

OTHER PUBLICATIONS

International Search Report; PCT/EP2009/009292; Dec. 28, 2009.

* cited by examiner

METHOD AND PLANT FOR PRODUCING ASPHALT MIXTURE

The invention relates to a method for producing asphalt mixture according to the introductory clause of claim 1 and to a plant for producing asphalt mixture according to the introductory clause of claim 19.

The invention is based in particular upon the recycling of reclaimed or recovered asphalt which arises during the dismantling and reconstruction of asphalt roads and on the basis of legal provisions, including the Recycling Management and Waste Act, is to be correspondingly recycled and returned to use. The reutilization should be carried out for economical and ecological reasons at least as building material, but primarily with reactivation of the binding agent bitumen in newly mixed asphalt. Reclaimed asphalt, for example milled asphalt or scarified asphalt, is thereby reduced to asphalt granulate and mixed with a pre-definable size distribution and corresponding to the classification in a defined quantity together with aggregates and bitumen.

Aggregates are understood in this connection to be fresh solid materials such as gravel, sand and mineral powder, also referred to as filling materials or fillers, which have a defined grain size composition and are used in a pre-definable quantity.

The Deutsche Asphaltverband e.V. describes in the Internet publication "Recycling of asphalt—New system of regulations points the way forward" of May 2008, Annexes 3.1 and 3.2: September 2009, the status of research regarding the recycling of asphalt, in particular in asphalt mixture for asphalt support layers, asphalt support top layers and asphalt foundation layers. Reference is also made to the currently valid legal provisions such as technical rules and standards and data sheets relating to addition quantities of asphalt granulate in new mixed materials.

In principle during the production of asphalt mixture with recycling of reclaimed asphalt in the form of asphalt granulate, a heating and drying of aggregates and asphalt granulate take place in at least one drum device, whereby hot gases serve as a heat source which are supplied in a counter flow or parallel flow to the aggregates and/or asphalt granulate to be heated. Conveyance then takes place, for example with conveyor belts or hot elevators, a classification of the aggregates and mixing with asphalt granulate and with heated bitumen in mixing devices, for example in a paddle vane type mixer, a siloing, in particular in hot silo installations. A hardening of the new binding agent is to be avoided through such pre-mixing.

In the cold method asphalt granulate is heated and dried through contact with fresh aggregates in the mixing device. The aggregates must therefore be correspondingly heated to a higher level, generally over 200° C., in order to achieve the heating and drying of the asphalt granulate and the mixed material temperature of around 160 to 180° C. necessary for incorporation and compaction of the asphalt mixture. In this method the addition quantity of the asphalt granulate is maximum 30%. Besides this low addition of asphalt granulate there is a further drawback in the necessity of pre-mixing the hot aggregates with the cold asphalt granulate and only adding the new binding agent bitumen after removal of the heat excess of the aggregates with simultaneous drying and heating of the asphalt granulate. Besides the thermal overloading of the drying and heating drum and the hot elevator this method leads to irregularities in the operation of the waste gas purification systems. During the heating and drying of asphalt granulate in a mixing plant considerable quantities of vapours are produced discontinuously, for example in a 60-second cycle, whereby these are conveyed into the waste gas system. The waste gas quantity hereby changes considerably in an intermittent manner. The waste gas system must thus be continuously operated with the maximum possible waste gas volume flow, thus inclusive of the maximum possible quantity of vapours. During times in which no vapour arises considerable quantities of false air are drawn into the system. The overall degree of efficiency of the plant is hereby impaired.

In the aforementioned publication of the Deutsche Asphaltverband e.V. further plantspecific schemas and methods for recycling of recovered asphalt are described. In the case of counter flow drums the addition of the asphalt granulate can take place via a central addition or through an adding apparatus on the drum outlet.

The mixture of aggregates and asphalt granulate is then fed via a sieve bypass pocket to the mixing device, for example a mixing tower. Addition quantities of around 40% reclaimed asphalt are intended to be possible with these methods.

An expensive double shell drum is required for a corresponding realisation.

Separate heating of asphalt granulate can be carried out separately from the aggregates in a parallel drum. In order to preserve the binding agent of the asphalt granulate and also to limit the emissions of the binding agent, a temperature of maximum 130° C. is to be observed. Heating to around 110° C. is preferred. Higher temperatures in the drum devices or mixing devices cause an intensive ageing of the bitumen and an impairment of its thermoplastic properties.

In case of continuous mixing installations, wherein the mixing process of the aggregates and the asphalt granulate takes place continuously in a drum or in a subsequently arranged continuous mixer and the asphalt granulate is previously heated together with the aggregates in a drum mixer or, however, is heated separately in a parallel drum, addition quantities of up to approximately 50% asphalt granulate are to be possible.

In principle the addition of asphalt granulate to new aggregates in a drum device, for example a drying drum, is limited in terms of quantity for the abovementioned processrelated reasons. Essential aspects are thereby an overheating of the asphalt granulate which leads to a burden on the environment through the volatile components of the bitumen and/or to a carbonisation of the bitumen contained in the asphalt granulate.

DE 195 30 164 A1 discloses a method and a drying drum for heating and drying asphalt granulate, wherein a separate hot gas generation is carried out in a hot gas generator. A maximum hot gas temperature of 600° C. is thereby to be set. In addition, through a special guidance of the hot gas and the asphalt granulate within the drum, it is endeavoured to ensure gentle heating which is intended to prevent cracking of the bitumen containing asphalt granulate and to minimise the occurrence of harmful substances.

DE 38 31 870 C1 discloses a method for asphalt production using granulated recovered asphalt, wherein hot aggregates dried to around 400° C. and cold asphalt granulate are added in predefined amounts to a mixer and mixed with bitumen and possibly filler material (limestone powder). In order to facilitate a higher proportion of recovered asphalt in the overall mixture a premixing or an addition in two steps into the mixer is carried out. At the end of the first mixing stage the mixture is to have a temperature of 170 to 180° C. and the overall mixing time of a mixer batch is to be around 60 seconds.

DE 10 2004 014 760 B4 discloses an asphalt plant and a method for producing asphalt, wherein aggregates are mixed with bitumen and possibly further additives and old asphalt as asphalt granulate to form a new asphalt mixture which can be incorporated. In order to guarantee a good mixing without damage, vaporisation or ignition of the bitumen a temperature range of from 170 to 190° C. is predefined for the dried and heated aggregates.

EP 0 216 316 A2 discloses a method for recycling of asphalt granulate, wherein aggregates and asphalt granulate are heated and dried in two separate drum driers and then mixed together with supplementary filler and bitumen portions in a mixer to form recycling mixed material. The recycling mixed material is directly supplied for further processing or, however, for intermediate storage for removal as required. Temperatures are not indicated in this document. Reference is only made to the corresponding provisions and to a considerable viscosity increase of the bitumen as a consequence of overheating of the aggregates. The heating of the asphalt granulate in the drying drum with directly connected burner takes place with concurrent flow and the waste gases are fed back to the burner of the drum drier for the aggregates as secondary and tertiary air.

In the methods known from DE 43 20 664 A1 recovered asphalt is heated in a separate drum by flue gas. Gentle heating of the reclaimed asphalt in order to prevent a thermal overheating of the bitumen is to be achieved in that the hot flue gas is conveyed in concurrent flow with the reclaimed asphalt material flow through the drum and in addition a portion of the flue gas leaving the drum at around 170° C. is fed back to the drum on the burner side in order to be able to further reduce the flue gas temperature and hence the temperature difference between the reclaimed asphalt and the flue gas. The flue gas portion not fed back is conveyed through a second drum, in which the aggregates are transported in a counter flow.

DE 20 2008 012 971 U1 discloses a plant for drying and heating granulated material for asphalt production, which comprises a rotating drying drum for drying and heating the aggregates and the asphalt granulate and a hot gas generator for supplying a hot gas flow. Having regard to the compliance with the maximum admissible binding agent temperature and end temperature of the asphalt material at the outlet of the drum dryer and the admissible waste gas temperature at the inlet of the waste gases into a filter installation, to which the waste gases are usually supplied, the degree of energy efficiency is to be increased and the particle load of the filter installation is to be reduced in that a portion of the hot gas flow is fed from the drying drum to the hot gas generator again. In addition the particles and fine parts are to be separated from the waste gas in a settling drum and then added to the material flow comprising recycling asphalt and aggregates. The waste gas flow which is fed back into the hot gas generator is preferably to be enriched with oxygen rich fresh air.

In the method described in DE 10 2006 038 614 A1 the plasticity of the bitumen reduced through thermal ageing is set in the reclaimed asphalt with the aid of a plasticiser. A combined addition of a hardener, preferably in the warm phase of the mixture, is also carried out. It is further described that recovered asphalt is generally heated having regard to the technical environmental provisions relating to air to up to 130 to 140° C. and the aggregates or the new mineral substances have to be heated, with an addition of around 50% reclaimed asphalt, clearly above 200° C. The degree of oxidation (ageing) of the bitumen in the reclaimed asphalt is seen as a problem in association with the degree of heating of the asphalt granulate limited to 140° C. in the recycling of recovered asphalts and the production of asphalt hot mixed materials. Through the addition of a plasticiser/hardener system a reduction of the incorporation temperature of the recovered asphalt from around 170° C. to 140° C. is to be achieved. As a result of the need for plasticisers and hardeners the cost of production of the asphalt mixture is increased considerably.

A disadvantage of the known methods and plants for the production of asphalt mixture, in particular when using asphalt granulate from recovered asphalt, results from the considerable quantities of false air. These are based upon the technology of the plant, lead to a high oxygen content in the hot gas and reduce the degree of heat efficiency of the plants. Generally the burners and/or hot gas generators used in the drying drums are operated with burners with fossil fuels and a waste gas recycling is carried out, wherein up to 50% of the waste gas flow is fed back to a hot gas generator.

A further disadvantage of the known methods and plants is the addition quantity of reclaimed asphalt for asphalting which is limited by technical aspects of process and plants, whereby the asphalt industry cannot adequately meet the constantly increasing requirements for an improved road infrastructure with the recycling of recovered asphalt as completely and with as high a quality as possible.

It is the object of the invention to create a method and an plant which guarantee the production of asphalt mixture in the required quality also with recycling of up to 100% reclaimed asphalt and which extraordinarily improve the efficiency of the asphalt production, in particular by saving raw materials and heat energy.

The object is achieved in terms of the method and devices according to at least one of embodiments of the present invention. Advantageous embodiments are contained in the description of the drawings.

According to the invention in the method for producing an asphalt mixture, wherein recovered asphalt in the form of asphalt granulate and/or new material in the form of aggregates is/are heated and dried together and/or separately in drum devices and then mixed in a mixing device with bitumen and possibly further additives to form an asphalt mixture which can be incorporated, at least the drying and heating of the asphalt granulate and/or the aggregates are carried out in a low oxygen atmosphere. The low oxygen atmosphere is thereby characterised by an oxygen content of 0 to 10%, preferably by an oxygen content of 0 to maximum 5%.

The invention is based on the recognition that through a low oxygen atmosphere at least in the drying and heating of the asphalt granulate and/or the aggregates, advantageously also in the conveyance of the heated and dried asphalt granulate or the heated and dried mixture of asphalt granulate and aggregates, respectively, and in the mixing with bitumen in a mixing device, an oxidation of the bitumen in the asphalt granulate and also in the fresh bitumen is prevented or at least reduced so that the thermoplastic properties of the bitumen are not disadvantageously changed.

It was recognised that solely a temperature increase to up to 250 or 300° C. does not cause any relevant damage to the bitumen, in particular in the reclaimed asphalt or asphalt granulate, respectively. In the production of bitumen in refineries a targeted oxidation process is thus carried out at temperatures in the range of from 250 to 270° C. over two to ten hours. A thermal decay (cracking) of the bitumen only arises at temperatures above 400° C. and leads to a disadvantageous compression of the bitumen structure with a change in the thermoplastic properties of the bitumen. In the presence of oxygen the hydrocarbon compounds are broken up in the aromatic rings of the bitumen. Without oxygen or with a very low oxygen content in the atmosphere, respectively, there is no thermal transformation of the hydrocarbon compounds of the bitumen. This was also ascertained for temperatures above 200° C., for example from 200 to 300° C. Bitumen can be stored in closed containers in long term at temperatures in the range of from 200 to 300° C. without a disadvantageous change in the thermoplastic properties.

Insofar as according to the invention asphalt granulate and/or aggregates is/are heated and dried together and/or separately in one or two drum devices in a low oxygen atmosphere a temperature increase of the asphalt granulate or the mixture of asphalt granulate and aggregates, respectively, to a temperature level in the range of from 180 to 200° C. is facilitated and this temperature level advantageously guarantees the production of asphalt mixture, also with solely recycling of reclaimed asphalt or with 100% asphalt granulate, respectively, with a lower addition of new bitumen and without fresh aggregates.

The low oxygen atmosphere according to the invention during the drying and heating in at least one drum device and preferably also during the conveyance and mixing with new bitumen in a mixing device is achieved using low oxygen gases which have according to the invention an oxygen content of maximum 10% and preferably an oxygen content of maximum 5% so that the oxygen content can preferably amount to 1, 2, 3, 4 or 5% or 6, 7, 8, 9 or 10%.

Low oxygen gases within the scope of the invention are understood to be in particular low oxygen process gases or waste gases of the most varied technical processes.

It is advantageous that asphalt granulate and/or aggregates can be heated and dried using low oxygen gases having a temperature in the range of from 500 to 1000° C. and then be conveyed to a mixing device and that, in order to guarantee a low oxygen atmosphere in the conveyance and mixing, using cold, low oxygen gases having a temperature in the range of from around 20 to around 150° C. or also by means of cooled low oxygen gases having a temperature of from around 150 to 300° C., a mixing of the hot, low oxygen gases with cold, low oxygen gases or respectively a cooling of the hot, low oxygen gases is carried out.

The asphalt granulate can be expelled from the drum devices with a temperature in the range of from approximately 130 to approximately 250° C.

It thereby lies within the scope of the invention for the supply bunkers and/or silos arranged before or after the mixing device, to be supplied with low oxygen gases.

The low oxygen gases can be obtained in particular through combustion of fossil fuels with a combustion air ratio/an air ratio $\lambda$=1.0 to 2.0, in particular $\lambda$=1.0 to 1.4, whereby the combustion can take place within and/or outside of the asphalt production/asphalt mixing installation.

In case of larger air ratios, for example from around $\lambda$>1.4, the combustion air can be mixed with low oxygen gases, for example waste gas, up to 100%.

It is advantageous to cool hot, low oxygen gases, which have been produced through combustion, indirectly, for example in heat exchangers, and/or directly through mixing with cold, low oxygen gases, to a temperature in the range of from 1000 to 400° C., preferably 900 to 600° C.

In principle the cold and hot low oxygen gases can originate from different sources and production plants. It is particularly efficient and also ecologically advantageous to use low oxygen gases which arise in technical processes as by-products or waste products, usefully also outside of the asphalt production. For example the nitrogen arising in metallurgical processes from air decomposition plants or low oxygen gases from gastight boiler plants, oxi-fuel plants and kilns, for example of the glass and metal production, can be used for the production of the inventive low oxygen atmosphere in the production of asphalt mixture. Cold, low oxygen gases can advantageously be brought to a higher temperature indirectly, for example in heat exchangers, or directly through mixing with hot, low oxygen gases. The use of low oxygen gases from processes and production plants outside of asphalt production is not only advantageous for the asphalt production but instead also means improved economy of the technical processes and plants in which the low oxygen gases arise. An improved efficiency in asphalt production is advantageously achieved in that the partial flows of the low oxygen gases from the individual devices can be brought together and fed to a waste gas purification unit and in that recirculation to the plant devices before and/or after waste gas purification is possible.

Cold, low oxygen gases are advantageously supplied for sealing the drum devices and/or conveying devices and/or silo devices and/or mixing devices and the connecting points between these devices and also in the area of the material inlet and outlet devices, in particular the drum devices. Sealing of this nature is to be carried out in particular in regions between the rotating and stationary parts of the drum devices.

It is advantageous that the low oxygen gases are formed and/or used at a positive pressure, for example at around 0.005 to 300 mbar, in particular up to 100 mbar, in a drum device and hot gas generator with burner, whereby a gas suction in the sealing and connecting regions can be carried out and the drawn-off gas can be fed to the burner of the drum device as a primary air portion and/or to the waste gas purification unit and/or to a flue. In this way the emissions of asphalt plants are advantageously reduced.

The low oxygen gases are advantageously supplied at least in part to a waste gas purification unit with drainage and then used as cold, low oxygen gases and used for example to seal the drum devices, conveying devices, mixing devices and/or silo devices.

The inventive installation for production of asphalt mixture, which comprises at least one drum device for heating and drying asphalt granulate made from reclaimed asphalt and/or new material in the form of aggregates and a mixing device for mixing the heated and dried asphalt granulate and/or aggregates with bitumen, is equipped with at least one source for low oxygen gases, in which the low oxygen gases with an oxygen content of maximum 10%, advantageously with an oxygen content of maximum 5%, and/or from which the low oxygen gases can be supplied to the at least one drum device.

Appropriately, at least the drum devices and advantageously also the conveying devices, silo devices and the mixing device are formed to be gastight and provided with seals which prevent false air quantities and a higher oxygen content in the devices. The inventive plant thus differs from the known plant variants which by reason of high false air quantities in the waste gases have an oxygen content of 10% to around 16%.

By way of a drum device a drying and heating drum, to which asphalt granulate and/or the aggregates are fed in counter flow or parallel flow to the hot, low oxygen gases, a counter flow drum for the asphalt granulate and/or the aggregates or a parallel drum for the asphalt granulate can be used, and the mixing devices can be mixing towers, drum mixers or continuous mixers.

In order to supply at least the drum device with low oxygen gases in overpressure, particularly in the range of from 0.005 to 300 mbar, it is useful to provide a suction device at connecting points and to feed the drawn-off low oxygen gases back to a waste gas purification unit, to the burner or into the circuit of the low oxygen gases.

As source for the low oxygen gases, the waste gases of the asphalt mixing installation or waste products and by-products of technical processes and operations outside of the asphalt mixing plant can be used.

A waste gas side connection of the plant for producing asphalt mixture with a coal grinding plant, in which raw coal is reduced in a grinding-drying process and for example ground to form coal dust is particularly advantageous. The low oxygen gases from the asphalt production process and the low oxygen gases from the coal grinding and coal drying can be used at least proportionally and thereby be used both in the installation for asphalt production and in the coal grinding, for example in order to fire the asphalt production installation. The economy of both processes is thus increased.

It is particularly advantageous for the production of hot, low oxygen gases to provide a hot gas generator, in particular with a steel combustion chamber. This generator can comprise a burner for gaseous, liquid and/or solid fuels.

The hot gas generator can have a gas mixer for mixing cold, low oxygen gases, for example from the waste gas purification unit, and the hot, low oxygen gases of the burner.

If the hot gas generator is a LOMA heating system of Loesche, wherein a Loesche perforated jacket (LOMA) heating system is provided, cold, low oxygen gases can be fed to the perforated jacket for mixing with the generated, hot, low oxygen waste gases.

Reference is made to the German patent DE 42 08 951 C2 for a hot gas generator with LOESCHE perforated jacket heating. A production of hot, low oxygen gases with good control facilities is possible with this hot gas generator.

In a particularly preferred embodiment a hot gas generator with a perforated jacket heating system is connected with a counter flow drum as a drum device for drying and heating for asphalt granulate and/or aggregates. The hot, low oxygen gases from the Loesche hot gas generator are transported in counter flow to the asphalt granulate and/or the aggregates in the counter flow drum and an inner recirculation circuit of the volatile hydrocarbon compounds from the bitumen is formed. The concentrations of the volatile hydrocarbon compounds thus increase in the drum to 5 to 15 times in comparison with a parallel drum.

It was found that in the treatment of the recovered asphalt with an increased temperature in comparison with conventional methods, in particular in a counter flow drum, with low oxygen atmosphere, the contact between bitumen and solid substances is improved and a 100% use of asphalt granulate made from recovered asphalt is possible without recognisable, disadvantageous effects upon the properties of the new mixture.

Figure 10:
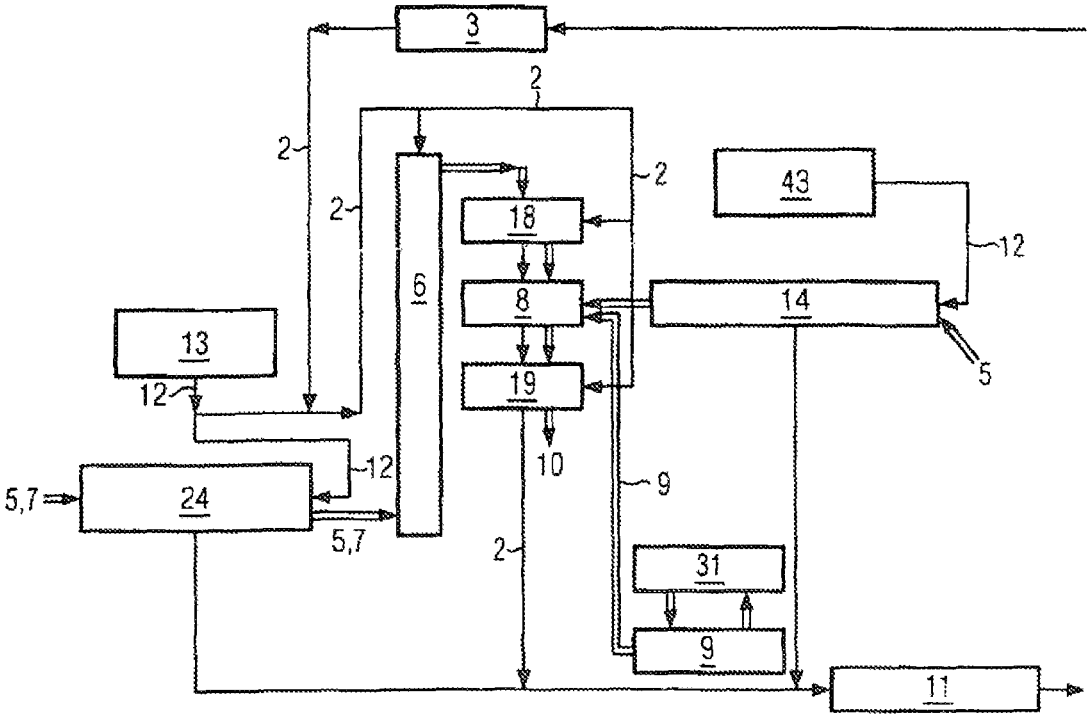
Figure 11:
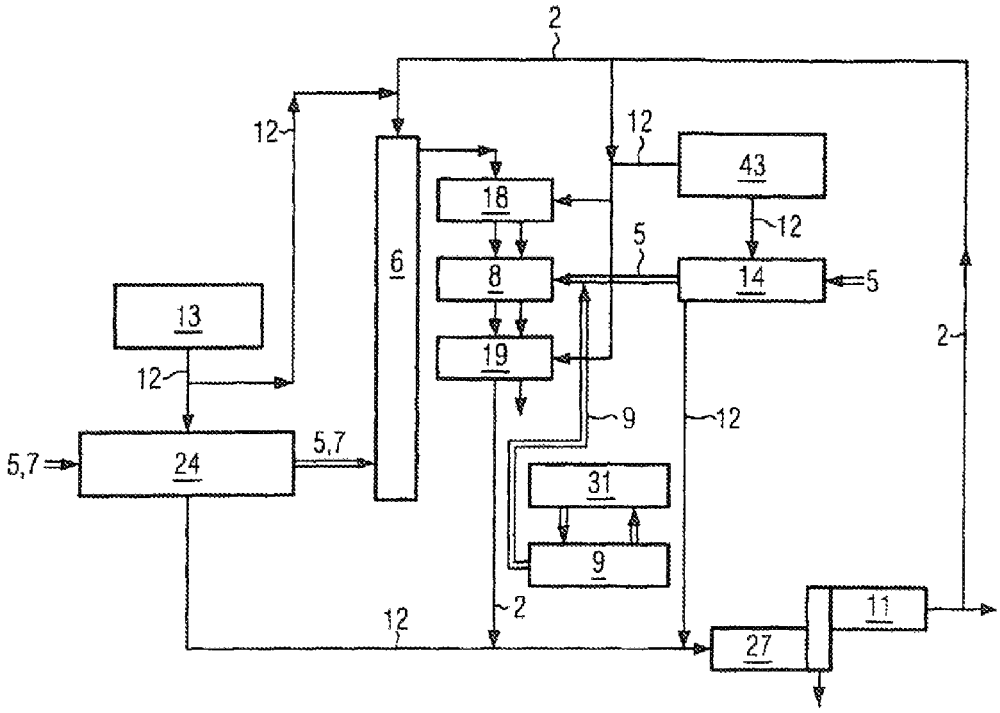
Figure 12:
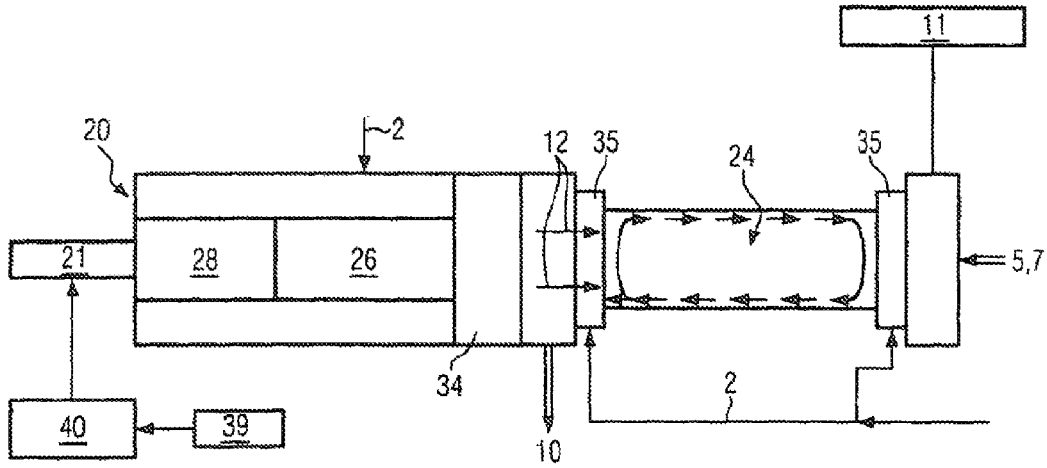

The invention is explained in further detail below by reference to the drawings in which the following are shown in highly schematised manner as plant schemas:

FIGS. 1 to 11 inventive installations for the production of asphalt mixture, in particular for carrying out the inventive method, and FIG. 12 a counter flow drum with a hot gas generator as a part of an inventive asphalt plant.

Identical features are provided with identical reference numerals. The gas supplying is indicated with single lines and the transport of the solid materials with double lines.

FIG. 1 shows a plant schema for the production of asphalt mixture which is supplied with cold, low oxygen gases from a source 3. The cold, low oxygen gases 2 have an oxygen content in the range of from 0 to 5%, for example 2% oxygen. The cold, low oxygen gases 2 can arise in technical processes outside of the asphalt production and can be for example waste gases from glass or metal production.

The installation schema of FIG. 1 shows the essential installation devices—a drying and heating drum 4 as one of the possible drum devices for heating and drying asphalt granulate 5 made from reclaimed asphalt and/or new material in the form of aggregates 7, a conveying device 6, for example a hot elevator, silo devices 18, 19 and a mixing device 8.

Using the conveying device 6 the dried and heated material is fed from the drying and heating drum 4 to a silo device 18, from which the mixture of asphalt granulate 5 and/or aggregates 7 is mixed in a defined proportion with bitumen 9, which is heated with the aid of an oil heater 31. The asphalt mixture 10 can be immediately incorporated or initially supplied to a silo.

A portion of the cold, low oxygen gases 2 is heated in a gas heater 15 using a heat source 37 to a temperature in the range of from 500 to 1000° C. and passed proportionally to the drying and heating drum 4. The flow guidance in the drying and heating drum 4 takes place in a counter flow to the asphalt granulate 5 and/or aggregates 7. A portion of the hot, low oxygen gases 12 from the gas heater 15 thus ensures in the drying and heating drum 4 a low oxygen atmosphere while another portion is mixed with a partial flow of the cold, low oxygen gases 2 and is fed to the conveying device 6, the silo devices 18, 19 and the mixing device 8 for production of a low oxygen atmosphere in these plant devices. The flow guidance within the silo devices 18, 19 and in the mixing device 8 takes place in a parallel flow. A heat source 37 for example an electric heater can be used. A direct or indirect heating of the cold, low oxygen gases 2 into hot, low oxygen gases 12 is also possible. The low oxygen gases from the conveying device 6, the silo devices 18, 19 and the mixing device 8 are collected and fed to a waste gas purification unit 11.

Figure 2:
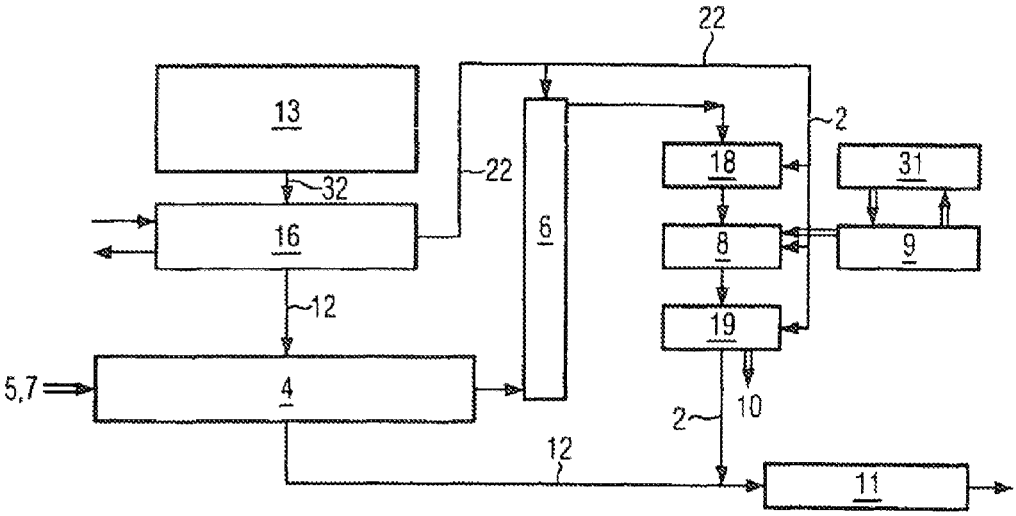

FIG. 2 shows the installation schema of an alternative installation for producing asphalt mixture 10, wherein asphalt granulate 5 and/or aggregates 7 are in turn transported in a drying and heating drum 4 in a counter flow to hot, low oxygen gases 12. The conveying device 6, silo devices 18, 19, mixing device 8, the oil heater 31 for tempering the bitumen 9 before mixing in the mixing device 8 coincide with the devices of the installation according to FIG. 1.

The hot, low oxygen gases 32 from a source 13 outside of the asphalt mixing installation have a temperature >1000° C. and are cooled either directly or, as shown in FIG. 2, in a gas cooler 16 to a temperature in the range of from 1000 to 500° C. and then passed proportionally to the drying and heating drum 4 and conveyed in counter flow to the transport of the asphalt granulate 5 and/or aggregates 7. The gas cooler 16 can for example be operated with a cooling medium, for example water.

A portion of the hot, low oxygen gases 12 from the gas cooler 16 is fed as cooled, low oxygen gases 22 with a temperature in the region of from 150 to 300° C. to the conveying device 6, the silo devices 18, 19 and the mixing device 8 for production of a low oxygen atmosphere with an oxygen content of maximum 10%, in particular 5%. After these devices the partial flows of the low oxygen gases are collected and fed to the waste gas purification unit 11.

Figure 3:
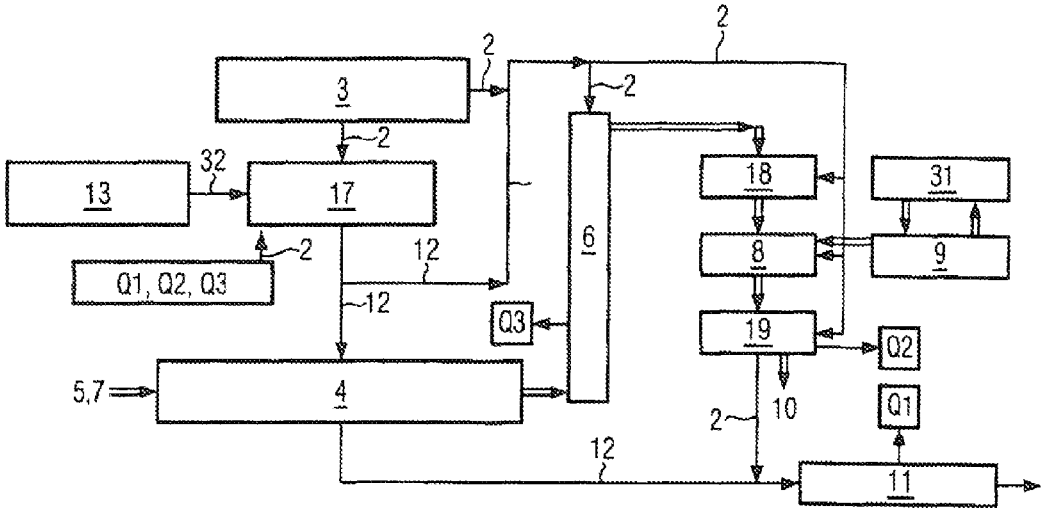

The installation according to FIG. 3 works on the basis of hot, low oxygen gases 32 with an oxygen content of maximum 5% and a temperature of around 1400° C. By way of a source 13 for these hot, low oxygen gases 32 technical processes outside of the asphalt production and asphalt mixing plant can be used, in particular a combustion of fossil fuels. The hot, low oxygen gases 32 are mixed in a gas mixer 17 with cold, low oxygen gases 2 and conveyed as hot, low oxygen gases 12 with a temperature in the range of from 500 to 1000° C. proportionally into the drying and heating drum 4. Another portion of the hot, low oxygen gases 12 is mixed with a portion of the cold, low oxygen gases 2 and fed to the conveying device 6 in counter flow, to the silo devices 18, 19 and to the mixing device 8 in parallel flow. Portions of the low oxygen gases from the conveying device 6, the silo devices 18, 19 and the mixing device 8 and from the waste gas purification unit 11, which are designated with Q1, Q2 and Q3, are fed back into the gas mixer 17, whereby the energy efficiency is increased. The remaining gas flows from the devices 4, 6, 18, 19, 8 and 10 are brought together and fed to the waste gas purification unit 11. The waste gases from the waste gas purification unit 11 are, preferably after a first purification stage, used as a source 3 for cold, low oxygen gases 2. A waste gas recycling value of 50 to 100% is achieved.

In the drying and heating drum 4 of FIGS. 1 to 3 the hot, low oxygen gases 12 are used with an overpressure of approx. 0.01 mbar to approx. 50 mbar. The temperature of the cold, low oxygen gases 2 preferably lies in the range of from 100 to 150° C. Reduced emissions in the production of asphalt mixture and simultaneously an efficient use of heat are associated therewith.

Figure 4:
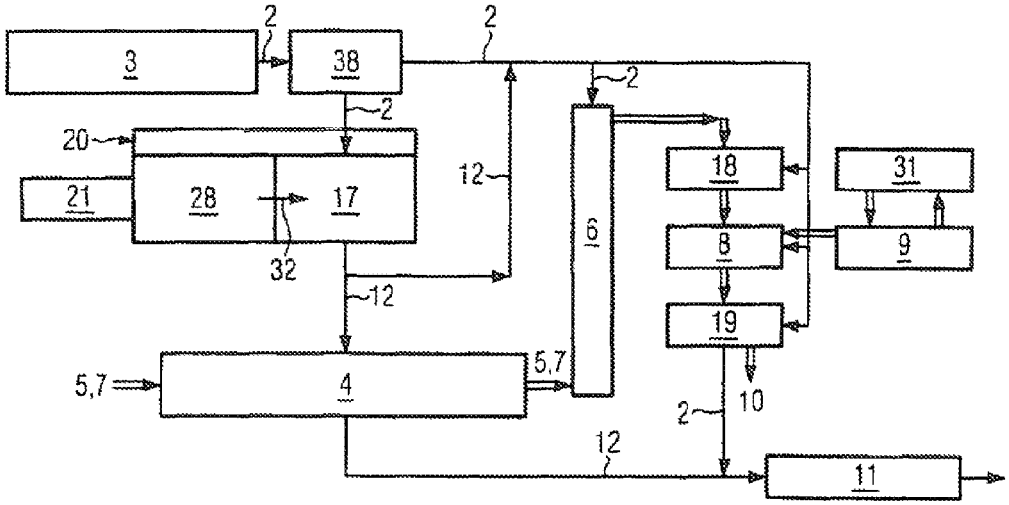

FIG. 4 shows an installation for producing asphalt mixture with a source 3 for cold, low oxygen gases 2 which are fed with the aid of a fan 38 to a hot gas generator 20. The hot gas generator 20 comprises a burner 21 for gaseous, liquid and/or solid fuels and a combustion chamber 28 for production of hot, low oxygen gases 32 with an oxygen content of approximately 3% and a temperature of approximately 1400° C. These hot, low oxygen gases 32 are mixed in a gas mixer 17 with cold, low oxygen gases 2 and cooled down to hot, low oxygen gases 12 with a temperature in the range of from 1000 to 500° C. After the gas mixer 17 the hot, low oxygen gases 12 are supplied to the drying and heating drum 4. A partial flow is branched off and mixed with the cold, low oxygen gases 2 and fed to the conveying device 6, the silo devices 18, 19 and the mixing device 8. Subsequently all partial flows of the low oxygen gases are collected again and fed to the waste gas purification unit 11.

Figure 5:
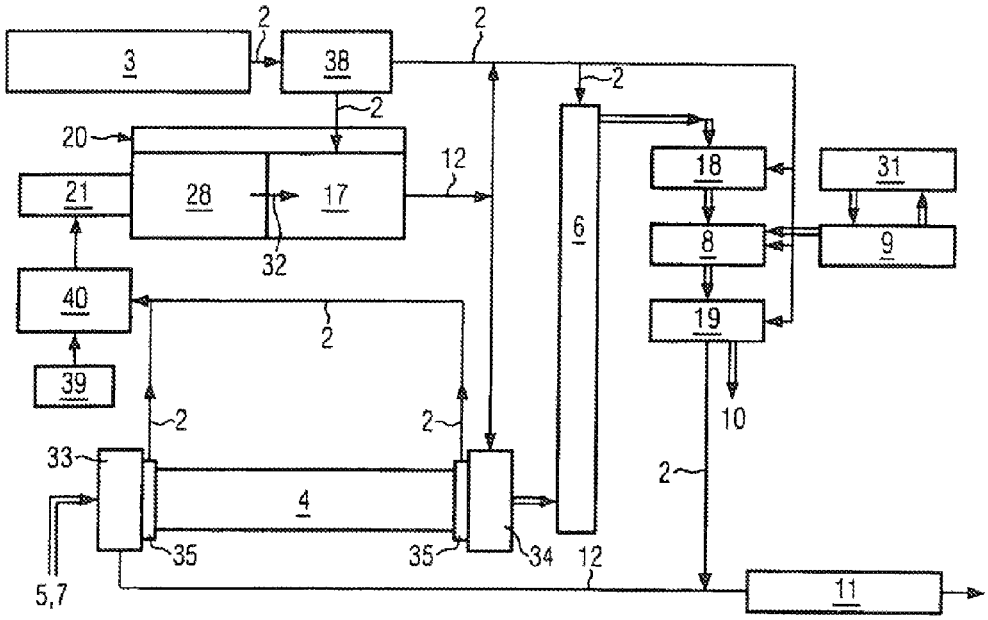

In the plant of FIG. 5, hot, low oxygen gases 32 are produced in a hot gas generator 20. The supplying of the burner 21 with the necessary combustion air 39 takes place using a fan 40 which draws-in both fresh air and low oxygen gases 2 from seals 35 of the drying and heating drum 4. The low oxygen gases 32 produced in the hot gas generator 20 are mixed in a gas mixer 17 with cold, low oxygen gases 2 from a source 3 and the hot, low oxygen gases 12 from the gas mixer 17 are fed in part to the drying and heating drum 4 and for another part mixed with cold, low oxygen gases 2 and then fed to the conveying device 6 and the further devices for ensuring a low oxygen atmosphere. The whole drying and heating process takes place with an overpressure of approx. 20 mbar, which is why the drying and heating drum 4 is equipped with seals 35, for example drum seals, from which the low oxygen gases are drawn and fed to the fan 40 for combustion in the burner 21 of the hot gas generator 20.

Figure 6:
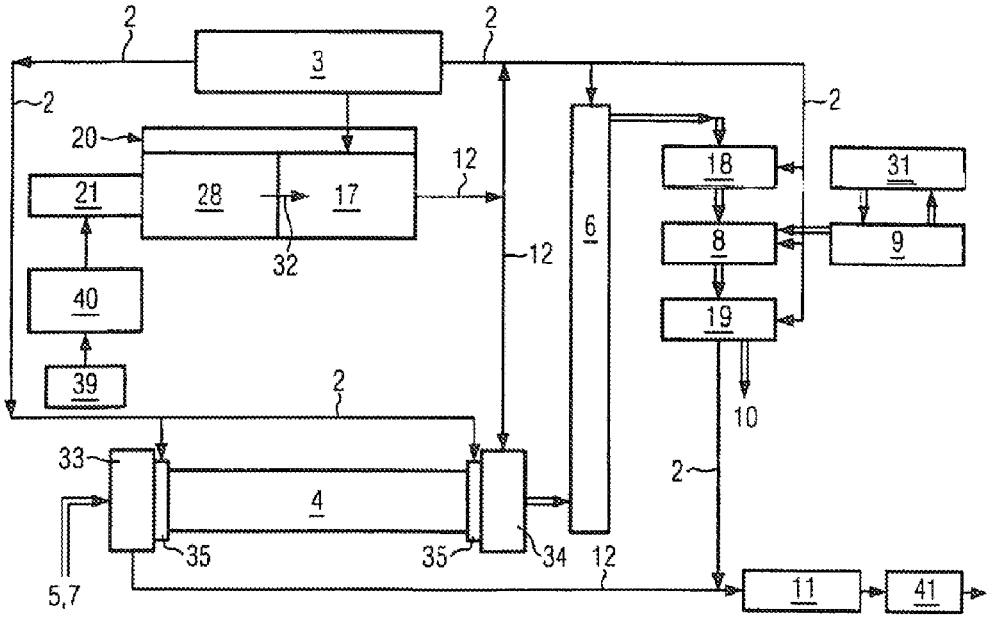

The plant according to FIG. 6 is operated with cold, low oxygen gases 2 from a source 3 which are heated and mixed in a hot gas generator 20 with gas mixer 17 to form hot, low oxygen gases 12. A portion of the cold, low oxygen gases 2 from the source 3 is fed to the seals 35 of the drying and heating drum 4 which is operated using a fan 41 in underpressure with 0.005 to 20 mbar. Insofar as the drying and heating drum 4 is operated in underpressure and the seals 35 are also impacted with cold, low oxygen gases 2, a false air penetration is prevented. The drying and heating drum 4 and the further installation devices are formed to be gastight. As a material inlet 33 and material outlet 34 rotary valves can be used (see also FIG. 7), which in underpressure operation of the drying and heating drum 4 guarantee a supply of low oxygen gases 2 and in overpressure operation of the drying and heating drum 4 guarantee a suction of low oxygen gases 2.

Figure 7:
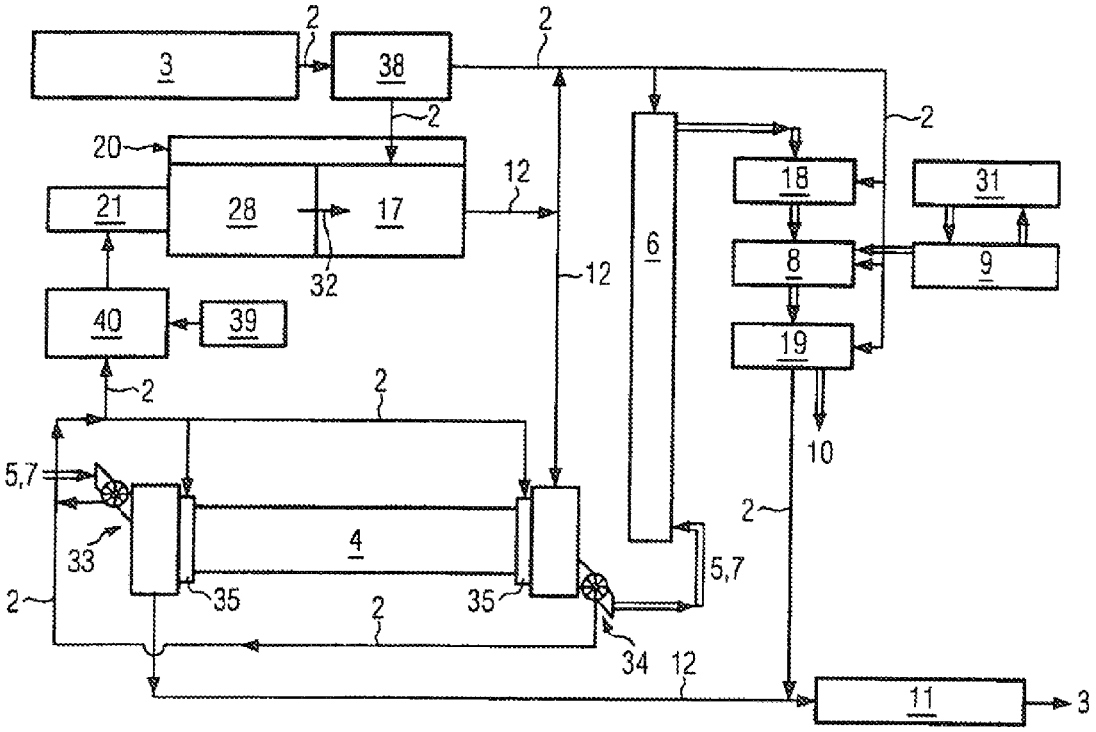

FIG. 7 shows an installation with a drying and heating drum 4 which is operated with an overpressure of 0.005 to 3 mbar. A fan 40 for supplying the burner 21 of the hot gas generator 20 draws in, besides fresh air 39, low oxygen gases 2 from the seals 35 of the drying and heating drum 4 and from the material inlet 33 and material outlet 34 and supplies them to the combustion process in the hot gas generator 20. Both the hot gas generator 20 and the drying and heating drum 4 work in overpressure operation. The waste gas of the installation after at least one stage of the waste gas purification unit 11 serves as source 3 for the cold, low oxygen gases 2.

Figure 8:
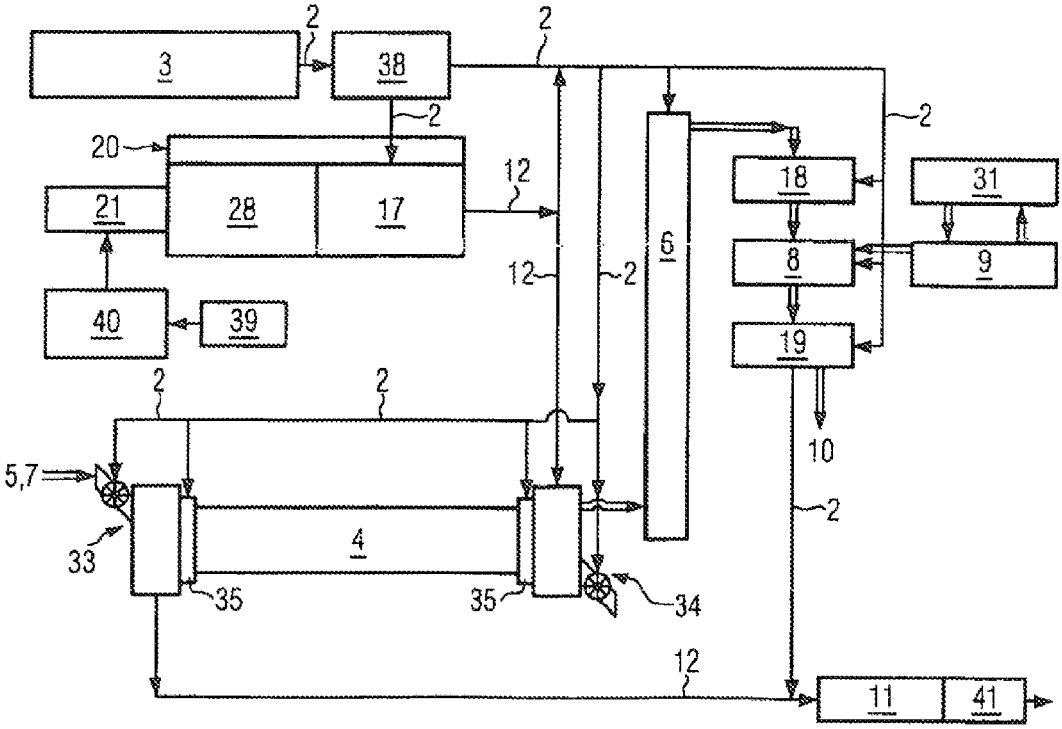

The plant according to FIG. 8 shows a gastight drying and heating drum 4, which is operated by means of a fan 41 at an underpressure of 0.005 to 20 mbar. The seals 35 and the material inlet 33 and material outlet 34 are supplied with low oxygen gases 2 in order to prevent a false air penetration. The cold, low oxygen gases 2 from a source 3 are fed using a fan 38 to the gas mixer 17 of the hot gas generator 20 and the hot, low oxygen gases 12 are fed proportionally to the drying and heating drum 4. A further portion is mixed with cold, low oxygen gases 2 and subsequently conveyed to the further devices 6, 8, 18, 19 of the installation.

Figure 9:
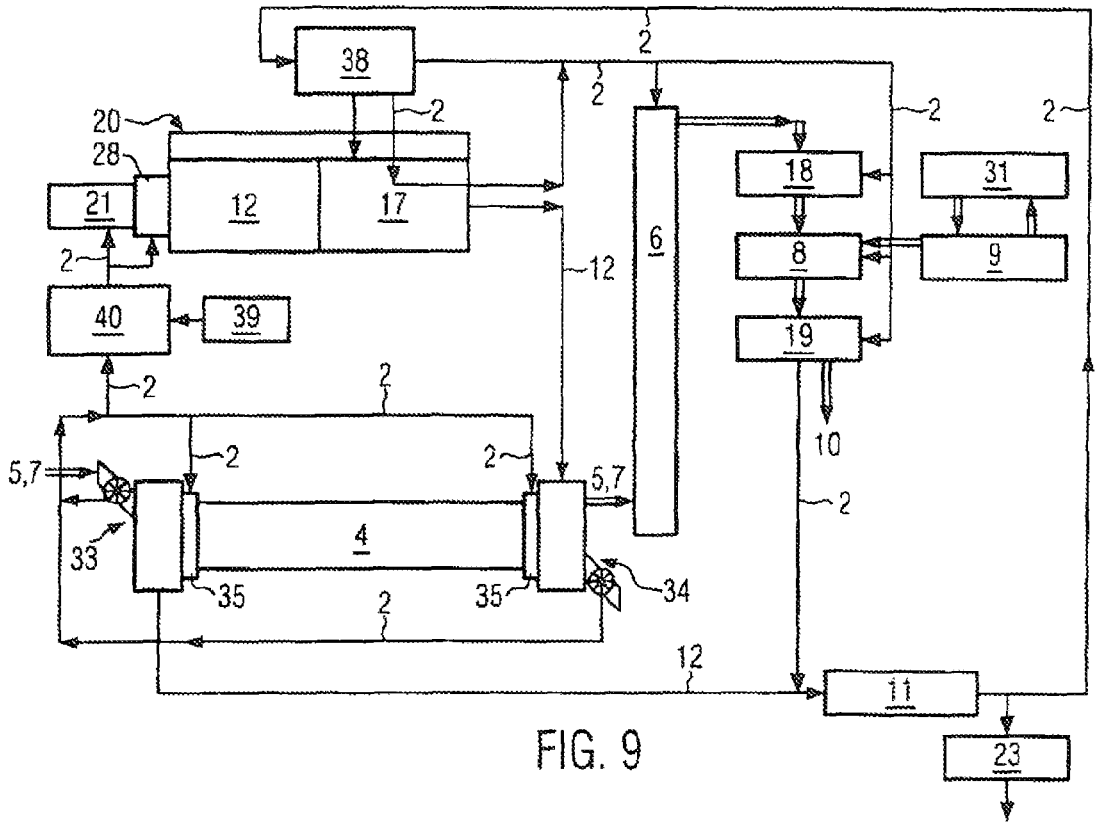

FIG. 9 shows an plant schema, wherein cold, low oxygen gases 2 are fed after the waste gas purification unit 11 using a fan 38 to a hot gas generator 20 with gas mixer 17. 20 to 30% of the cold, low oxygen gases 2, preferably 25 to 30%, are fed to a muffle 28 of the hot gas generator 20, and 10 to 20% of the cold, low oxygen gases 2, preferably 15 to 20%, are fed to the primary air 39 of the burner 21. A reduction of the $NO_x$ emissions is advantageously associated therewith.

The fan 40 for the burner 21 of the hot gas generator 20 also draws in, besides the combustion air 39, low oxygen gases 2, 12 from the seals 35 of the drying and heating drum 4 and from the material inlet 33 and material outlet 34 thereof. The waste gases from the waste gas purification unit 11, in particular a waste gas portion from a first stage, serve as a source for the cold, low oxygen gases 2. The remaining waste gases can be fed to a second stage 23 of the waste gas purification unit.

The installation according to FIG. 10 is operated with two drum devices 14, 24. Both drum devices 14, 24 work in a low oxygen atmosphere. Hot, low oxygen gases are hereby fed from a source 13 with a temperature in the range of from 500 to 1000° C. and an oxygen content of approximately 3% to a counter flow drum 24 in counter flow to asphalt granulate 5 and aggregates 7. The heated and dried material from the counter flow drum 24 is passed using a conveying device 6, for example a hot elevator, to the mixing device 8. In addition asphalt granulate 5, which is heated and dried in a parallel drum 14 using hot, low oxygen gases 12 from a source 43 and with a temperature in the range of from 300 to 1000° C., goes into the mixing device 8 and is mixed with bitumen 9 to form an asphalt mixture 10 which can be incorporated. The partial flows of the low oxygen gases from the installation devices 6, 8, 18, 19 are in turn fed to a waste gas purification unit 11.

The plant according to FIG. 11 comprises two drum devices 14, 24, namely a counter flow drum 24 for heating and drying asphalt granulate 5 and aggregates 7 and a parallel drum 14 for heating and drying 100% asphalt granulate 5. The parallel drum 14 is operated in the installation according to FIG. 10 with hot, low oxygen gases 12 with a temperature of 500 to 1000° C. in underpressure, whereby the corresponding seals and impacting of the material inlet and material outlet are not shown. The hot, low oxygen gases 12 from a source 13 are mixed proportionally with cold, low oxygen gases 2 from the waste gas purification unit 11 and cooled down to a temperature in the range of from 100 to 200° C. in order to serve thereafter for production of the low oxygen atmosphere in the conveying device 6, in the silo devices 18, 19 and mixing device 8.

The partial flows of the low oxygen gases from the devices of the plant are collected and fed to a cooler 27 for water separation and subsequently to a waste gas purification unit 11 which serves as a source for the cold, low oxygen gases 2 and thus guarantees an advantageous waste gas recycling.

FIG. 12 shows, as a part of an installation for production of asphalt mixture, a counter flow drum 24, in which asphalt granulate 5 and aggregates 7 are heated and dried in counter flow with hot, low oxygen gases 12. The hot, low oxygen gases 12 can preferably be generated in a hot gas generator 20 with a Loesche perforated jacket (LOMA) heater. The heating and drying of the asphalt granulate 5 made from reclaimed asphalt and/or aggregates 7 takes place in the counter flow method with the hot, low oxygen gases 12 from the hot gas generator 20 with a perforated jacket 26 as or with a gas mixer. As a result of the counter flow an inner circulation of the volatile bitumen components from the asphalt granulate 5 arises insofar as these components evaporate on the hot end of the drum and condense on the cold end of the drum. The inner concentration of the volatile bitumen components increases to 5 to 15 times in comparison with a parallel drum. An improved contact between the bitumen and the solid materials is advantageous, whereby the quality of the new incorporation-ready asphalt mixture 10 is increased. A seal 35 is provided which is designed in such a way that an impacting with cold, low oxygen gases 2 can take place. The waste gases from the counter flow drum 24 and from the seals 35 are fed to a waste gas purification unit 11. The outlet 34 for the incorporation-ready asphalt mixture 10 takes place in the feed region of the hot, low oxygen gases 12. It is advantageously possible in the counter flow drum 24 with LOMA hot gas generator 20 solely asphalt granulate 5 made from recovered asphalt to be heated and dried and thus for a 100% asphalt recycling to be achieved.

The invention claimed is:

1. Method for producing asphalt mixture, comprising:

heating and drying recovered asphalt as asphalt granulate and/or new material in the form of aggregates in drum devices together or separately; and subsequently mixing the heated and dried asphalt and/or aggregates in a mixing device with bitumen to form an incorporation-ready asphalt mixture, wherein the mixing of the heated and dried asphalt granulate and/or the aggregates is carried out in a low oxygen atmosphere, in which the oxygen content is maximum 10%, wherein the asphalt granulate and/or the aggregates is/are dried and heated in the drum devices utilizing low oxygen gases having a temperature in the range of from 500 to 1000° C. and subsequently conveyed to the mixing device and the conveyance and mixing are carried out in a low oxygen atmosphere, whereby cold, low oxygen gases having a temperature in the range of from approximately 20 to approximately 150° C. or cooled, low oxygen gases having a temperature in the range of from approximately 150 to approximately 300° C. are fed to a conveying device and the mixing device, and siloing of the heated and dried asphalt granulate and/or aggregates before the mixing with the bitumen and/or siloing of the incorporation-ready asphalt mixture in a low oxygen atmosphere is/are carried out.

2. Method according to claim 1, wherein cold, low oxygen gases, hot, low oxygen gases and/or cooled down low oxygen gases are fed with an oxygen content in the range of from 0 to 5% and a temperature in the range of from 500° C. to 1000° C. to the drum devices, conveying devices and mixing device.

3. Method according to claim 1, wherein the asphalt granulate is expelled from the drum devices with a temperature in the range of from approximately 130 to approximately 250° C.

4. Method according to claim 1, wherein cold, low oxygen gases and/or hot, low oxygen gases are supplied, which are generated in the combustion of fossil fuels with a combustion air ratio $\lambda$=1.0 to 2.0, within and/or outside of the asphalt production.

5. Method according to claim 1, wherein cold, low oxygen gases and/or hot, low oxygen gases are supplied which arise as by-products or waste products in technical processes outside of the asphalt production.

6. Method according to claim 1 wherein cold, low oxygen gases are heated in gas heaters to a temperature in the range of from approximately 500 to approximately 1000° C. and are passed as hot, low oxygen gases to the drum devices or in that hot, low oxygen gases are cooled down to a temperature in the range of from approximately 1000 to approximately 500° C. in gas coolers and fed to the drum devices or cold, low oxygen gases and low oxygen gases having a temperature >1000° C., are mixed in a gas mixer to form hot, low oxygen gases with a temperature in the range of between approximately 500 and approximately 1000° C. and then fed to the drum devices and a portion of the hot gases, after the gas heater or gas mixer, is mixed with the cold, low oxygen gases which are then fed to the conveying devices and the mixing device or a portion of the hot gases from the gas cooler is cooled further and fed as cooled down, low oxygen gases with a temperature in the range of between approximately 150 and approximately 300° C. to the conveying devices and the mixing device.

7. Method according to claim 1, wherein the drying and heating of the asphalt granulate and/or the aggregates and/or the conveyance and/or the mixing to form the incorporation-ready asphalt mixture and/or the siloing is/are carried out with an overpressure of the low oxygen gases in the range of from approximately 0.005 to 300 mbar or with an underpressure of the low oxygen gases in the range of from 0.005 to 20 mbar.

8. Method according to claim 1 wherein the low oxygen gases are fed from the drum devices and/or from the conveying devices, mixing devices and/or silos to a waste gas purification unit and/or mixed with hot, low oxygen gases and/or heated to a temperature in the range of from approximately 500 to approximately 1000° C. and utilized again in the drum devices.

9. Method according to claim 1,
wherein
cold, low oxygen gases are heated in a hot gas generator and then cooled down in a gas mixer with cold, low oxygen gases to form hot, low oxygen gases with a temperature in the range of from approximately 1000 to approximately 500° C. and passed to the drum devices and/or further cooled down by means of cold, low oxygen gases and passed to conveying, mixing and silo devices.

10. Method according to claim 9,
wherein
cold, low oxygen gases which arise in the asphalt production are utilized in the hot gas generator, wherein the cold, low oxygen gases are mixed proportionally with a fuel for a burner of the hot gas generator and/or mixed proportionally with primary air for the burner of the hot gas generator and/or fed to a muffle of the hot gas generator.

11. Method according to claim 9,
wherein
cold, low oxygen gases are supplied for sealing the drum devices and/or conveying devices and/or silo devices and/or mixing device and connections between these devices as well as a material inlet and material outlet of the drum devices and/or drawn off by the drum devices and/or conveying devices and/or silo devices and/or mixing device and connections between these devices as well as a material inlet and material outlet of the drum devices during overpressure operation.

12. Method according to claim 1,
wherein
at least portions of the low oxygen gases arising during the asphalt production are fed to a waste gas purification unit and drained and subsequently heated to hot, low oxygen gases and utilized in the drum device or utilized as cold, low oxygen gases for sealing the drum devices, conveying device, mixing device and/or silo devices.

13. Method according to claim 1,
wherein
the asphalt granulate and/or the aggregates are passed in counter flow or in parallel flow in relation to hot, low oxygen gases to a drying and heating drum as a drum device and are dried and heated with an underpressure in the range of from approximately 0.005 to 20 mbar or with an overpressure in the range of from approximately 0.005 to 300 mbar.

14. Method according to claim 1,
wherein
the asphalt granulate and/or the aggregates is/are transported, heated and dried in a counter flow drum as a drum device in counter flow to hot, low oxygen gases.

15. Method according to claim 1,
wherein
solely asphalt granulate is heated and dried in a parallel drum as a drum device by means of hot, low oxygen gases which are fed in parallel and subsequently this asphalt granulate is mixed with a mixture of asphalt granulate and aggregates or only with aggregates from a counter flow drum or a silo in the mixing device with bitumen.

16. Method according to claim 15,
wherein
the hot, low oxygen gases are generated or heated in a hot gas generator with a perforated jacket as a gas mixer or in a hot gas generator with a gas mixer.

17. Method according to claim 16,
wherein
the asphalt granulate and/or the aggregates is/are transported, heated and dried in a drum device in counter flow to the hot, low oxygen gases,
in that simultaneously the hot, low oxygen gases are enriched with gas and/or vapour-form substances from the bitumen of the asphalt granulate and
in that the hot, low oxygen gases are fed after the condensation of the substances from the bitumen to a waste gas purification unit.

18. Plant for producing asphalt mixture,
having at least one drum device for heating and drying asphalt granulate made from reclaimed asphalt and/or new material in the form of aggregates and a mixing device for mixing the heated and dried asphalt granulate and/or aggregates with bitumen, as well as having at least one source for low oxygen gases with an oxygen content of maximum 10%, which can be fed to the mixing device,
wherein
the at least one source for low oxygen gases with an oxygen content of maximum 10%, in which the low oxygen gases arise and/or from which the low oxygen gases can be fed, is connected to the drum device as well as to a conveying device for the heated and dried asphalt granulate and/or aggregates and to silo devices before and/or after the mixing device for supplying the low oxygen gases with an oxygen content of maximum 10%.

19. Plant according to claim 18,
wherein
the drum device is formed to be gastight for an overpressure of the low oxygen gases in the range of from 0.005 to 300 mbar or for an underpressure of the low oxygen gases in the range of from 0.005 to 20 mbar.

20. Plant according to claim 18,
wherein
the conveying device for the heated and dried asphalt granulate and/or aggregates and the silo devices and the mixing device are designed to be gastight.

21. Plant according to one of the claim 18,
wherein
a material inlet and material outlet of the drum device are designed to be gastight and comprise seals, to which cold, low oxygen gases can be fed in case of underpressure in the drum device and from which cold, low oxygen gases can be drawn off in case of overpressure in the drum device.

22. Plant according to one of the claim 18,
wherein
the source for low oxygen gases is disposed inside or outside of the asphalt mixing plant.

23. Plant according to one of the claim 18,
wherein
waste gases from a waste gas purification unit of the asphalt mixing plant are a source for cold, low oxygen gases and a waste gas recycling value of approximately 50 to approximately 100% can be achieved.

24. Plant according to one of the claim 18,
wherein
gas heater, gas cooler or gas mixer are arranged for production of cold, low oxygen gases with a temperature in the range of from approximately 20 to 150° C., hot, low oxygen gases with a temperature in the range of from 500 to 1000° C. and cooled down, low oxygen gases with a temperature in the range of from 150 to 300° C.

25. Plant according to one of the claim 18, wherein a hot gas generator with a burner for gaseous, liquid and/or solid fuels is provided, to which also low oxygen gases as combustion air can be fed via a return line to the burner, and with a gas mixer for mixing cold, low oxygen gases, with the hot, low oxygen gases produced in the hot gas generator.

26. Plant according to claim 25, wherein the hot gas generator is equipped with a steel combustion chamber or comprises a Loesche perforated jacket (LOMA) heating with a perforated jacket, to which cold, low oxygen gases can be fed for mixing with the hot, low oxygen gases generated in the hot gas generator.

27. Plant according to claim 18, wherein a hot gas generator with perforated jacket (LOMA) heating is connected to a counter flow drum as a drum device, in which the transport of the asphalt granulate and/or aggregates, takes place contrary to the flow direction of the hot, low oxygen gases from the perforated jacket of the hot gas generator, and in that sealing devices are provided between the movable and non-movable parts of the counter flow drum which can be impacted with cold, low oxygen gases.

28. Plant according to one of the claim 18, wherein a source for low oxygen gases is a grinding-drying plant for raw coal, and in that low oxygen gas arising during the grinding of the coal as well as the low oxygen gases from the asphalt mixing plant are connected and can be used in both plants.

* * * * *